United States Patent [19]

Gencarelli et al.

[11] B 3,988,249

[45] Oct. 26, 1976

[54] EXTREME PRESSURE ADDITIVE FOR LUBRICANTS

[75] Inventors: Richard A. Gencarelli, Cheshire; Keith A. Hughes, Naugatuck; John F. Sierakowski, Watertown, all of Conn.

[73] Assignee: Uniroyal Inc., New York, N.Y.

[22] Filed: Feb. 11, 1974

[21] Appl. No.: 441,723

[44] Published under the second Trial Voluntary Protest Program on March 16, 1976 as document No. B 441,723.

[52] U.S. Cl. ..... 252/33.6; 260/446

[51] Int. Cl.[2] ..... C10M 1/38; C10M 1/54

[58] Field of Search ..... 260/446; 252/33.6, 42.7

[56] References Cited

UNITED STATES PATENTS

| | | | |
|---|---|---|---|
| 2,492,314 | 12/1949 | Olin et al. | 260/446 X |
| 3,139,405 | 6/1964 | Farmer et al. | 252/33.6 |
| 3,317,575 | 5/1967 | Breindel et al. | 260/446 X |
| 3,355,472 | 11/1967 | Remes et al. | 260/446 |
| 3,707,498 | 12/1972 | Milsom | 252/33.6 |

OTHER PUBLICATIONS

Chem. Abstracts, v 66, 97175j, (1967).

*Primary Examiner*—Helen M. S. Sneed
*Attorney, Agent, or Firm*—James J. Long

[57] ABSTRACT

Antimony N-(2-octyl)-N-ethyldithiocarbamate confers extreme pressure properties on lubricants.

4 Claims, No Drawings

EXTREME PRESSURE ADDITIVE FOR LUBRICANTS

This invention relates to an extreme pressure lubricant composition and a chemical useful in such composition.

It is known to improve the extreme pressure properties of lubricants by adding various chemicals, including certain antimony dialkyldithiocarbamates, to the lubricant (see, for example U.S. Pat. No. 3,139,405, Farmer et al., June 30, 1964). It is also known, as disclosed in U.S. Pat. No. 3,707,498, Milson, Dec. 26, 1972, to protect lubricating oils, including synthetic lubricants such as dicarboxylic acid ester based fluids, against oxidation by adding certain combinations of materials including metal (preferably zinc, cadmium, lead or antimony) dialkyldithiocarbamates wherein the alkyl groups contain 3 to 10 carbon atoms and may be straight chain or branched, the two alkyl groups being the same or different. Examples are antimony propyloctyldithiocarbamate and zinc isopropyloctyldithiocarbamate.

In accordance with the invention it has now been discovered, unexpectedly, that antimony N-(2-octyl)-N-ethyldithiocarbamate is a surprisingly superior extreme pressure additive for lubricants.

Antimony N-(2-octyl)-N-ethyldithiocarbamate, which is believed to be a new chemical compound, has the structural formula

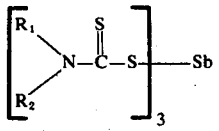

where $R_1$ is 2-octyl and $R_2$ is ethyl.

Lubricating oils which can be used as base oils for the lubricating oil compositions according to the invention include a wide variety of lubricating oils, such as dicarboxylic acid esters (e.g., those which are prepared by esterifying such dicarboxylic acids as adipic acid, azelaic acid, suberic acid, sebasic acid, succinic acid, fumaric acid, maleic acid, etc., with alcohols, such as butyl alcohol, hexyl alcohol, 2-ethylhexyl alcohol, dodecyl alcohol, etc.). (See U.S. Pat. Nos. 3,505,225, Wheeler Apr. 7, 1970, col. 5, lines 42–45 and 3,655,562, Chao et al., Apr. 11, 1972, col. 3, lines 29 etc.)

The above base oils may be used individually or in combinations thereof, wherever miscible or whereever made so by the use of mutual solvents.

In practicing the invention the base lubricant and the extreme pressure additive of the invention are mixed together in any conventional manner. Usually the amount of antimony N-(2-octyl)-N-ethyldithiocarbamate employed is from about 1% or less to about 10% or more, based on the weight of the base lubricant, but other amounts may be used.

The following examples will serve to illustrate the practice of the invention in more detail.

EXAMPLE I

Antimony N-(2-octyl)-N-ethyldithiocarbamate

In a 3-liter, three-neck, round-bottom flask equipped with a stirrer, thermometer, dropping funnel and condenser was placed 157 g. (grams) (1.0 mole) of N-(2-octyl)-N-ethylamine, 49 g. (0.168 mole) of antimony trioxide and 1000 ml. (milliliters) of hexane. The stirred mixture was heated to reflux (68°C.) and 80 g. (1.05 moles) of carbon disulfide was added over a period of 1 hour. The mixture was stirred at reflux for an additional 3 hours, and then the water generated during the reaction was azeotroped off (9 ml.). The mixture was filtered hot in order to remove any unreacted antimony oxide. The hexane solution was cooled to room temperature and the hexane was then removed at reduced pressure. A viscous oil was isolated having an Index of refraction $N_D^{22}=1.627$.

EXAMPLE II

Timken Load Carrying Test

The dithiocarbamates shown in Table I were dissolved in oil at a concentration of 2.5% based on the weight of the oil. The oil was a di-2-ethylhexyl sebacate synthetic ester based fluid lubricant having a specific gravity of 0.912 at 60°/60°F., viscosity 37.3 Saybolt universal seconds at 210°F. and 68.6 SUS at 100°F. The thus-compounded fluid was then evaluated using the Timken lubricant tester to determine the load carrying capacity of the lubricant following the procedure described in U.S. Pat. No. 3,139,405 referred to above. The passing load and failing load were observed, with the results shown in Table I, in pounds.

The various metal dialkyldithiocarbamates employed have the formula

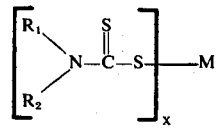

where $R_1$, $R_2$ and M have the values shown in Table I and $x$ is the valence of the metal. Run 3, utilizing antimony N-(2-octyl)-N-ethyldithiocarbamate represents the practice of the invention and gave unexpectedly superior results compared to other compounds, as evidenced by the high values for the pass and fail loads. Run 6, using a chemical of U.S. Pat. No. 3,707,489 referred to above, namely zinc isopropyl-octyldithiocarbamate (also known as zinc N-isopropyl-N-(n-octyl)dithiocarbamate), gave a decidedly inferior result in this test. Runs 2 and 4 were less effective. Run 8 represents a commercially available compound (Vanlube 73, trademark). The invention, Run 3, provided a marked (about 25%) improvement, especially over the prior art Runs 5 and 8.

TABLE I

| | | | Stabilization of Lubricating Fluid | | |
|---|---|---|---|---|---|
| Run | Metal | $R_2$ | $R_1$ | Pass, lbs. | Fail, lbs. |
| 1 | — | no stabilizer | | <5 | 5 |
| 2 | Sb | ethyl | 2-heptyl | 90 | 95 |
| 3* | Sb | ethyl | 2-octyl | 105 | 110 |
| 4 | Sb | ethyl | 2-nonyl | 70 | 75 |
| 5 | Sb | isopropyl | n-octyl | 80 | 90 |

TABLE I-continued

| Run | Metal | $R_2$ | Stabilization of Lubricating Fluid | | |
|---|---|---|---|---|---|
| | | | $R_1$ | Pass, lbs. | Fail, lbs. |
| 6 | Zn | isopropyl | n-octyl | 10 | 20 |
| 7 | Sb | isopropyl | $C_{14}$—$C_{18}$ alkyl | 25 | 30 |
| 8 | Sb | amyl | amyl | 70 | 75 |

*Compound of invention.

We claim:

1. Antimony tris [N-(2-octyl)-N-ethyldithiocarbamate].

2. A composition comprising a synthetic lubricant in admixture with antimony N-(2-octyl)-N-ethyldithiocarbamate in amount sufficient to confer extreme pressure properties on the lubricant.

3. A synthetic lubricant composition suitable for extreme pressure service comprising a dicarboxylic acid ester base lubricant in admixture with from 1 to 10% by weight of antimony N-(2-octyl-N-ethyldithiocarbamate as a stabilizer for the said lubricant.

4. A synthetic lubricant as in claim 3 in which the said ester is di-2-ethylhexyl sebacate.

* * * * *